US008721285B2

(12) United States Patent
Liang

(10) Patent No.: US 8,721,285 B2
(45) Date of Patent: May 13, 2014

(54) TURBINE BLADE WITH INCREMENTAL SERPENTINE COOLING CHANNELS BENEATH A THERMAL SKIN

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 586 days.

(21) Appl. No.: 12/397,766

(22) Filed: Mar. 4, 2009

(65) Prior Publication Data

US 2010/0226788 A1 Sep. 9, 2010

(51) Int. Cl.
*F01D 5/18* (2006.01)

(52) U.S. Cl.
CPC ..... *F01D 5/188* (2013.01); *F05D 2250/185* (2013.01); *F05D 2260/22141* (2013.01)
USPC ..... 416/97 A; 415/115; 416/96 R

(58) Field of Classification Search
CPC ..... F01D 5/187–5/188; F05D 2250/185; F05D 2260/22141
USPC ..... 416/97 R, 97 A
See application file for complete search history.

(56) References Cited

U.S. PATENT DOCUMENTS 3,191,908 A * 6/1965 Petrie et al. ..... 416/96 R
3,533,711 A 10/1970 Kercher
3,628,885 A 12/1971 Sidenstick et al.
4,073,599 A 2/1978 Allen et al.
4,162,136 A 7/1979 Parkes
4,767,268 A 8/1988 Auxier et al.
4,802,823 A 2/1989 Decko et al.
5,027,604 A 7/1991 Krueger
5,177,954 A 1/1993 Paul
5,215,431 A * 6/1993 Derrien ..... 415/115
5,725,355 A 3/1998 Crall et al.
5,820,337 A * 10/1998 Jackson et al. ..... 415/200
6,508,000 B2 1/2003 Burke et al.
6,638,639 B1 10/2003 Burke et al.
6,705,836 B2 * 3/2004 Bourriaud et al. ..... 416/97 R
7,090,461 B2 8/2006 Liang
7,527,474 B1 * 5/2009 Liang ..... 416/1
7,534,089 B2 * 5/2009 Liang ..... 416/97 R
7,717,675 B1 * 5/2010 Liang ..... 416/95
7,857,589 B1 * 12/2010 Liang ..... 416/97 R
8,047,788 B1 * 11/2011 Liang ..... 416/97 R
2003/0026697 A1 2/2003 Subramanian et al.
2005/0053458 A1 3/2005 Liang
2006/0153678 A1 7/2006 Liang
2008/0145236 A1 6/2008 Liang
2010/0239431 A1 * 9/2010 Liang ..... 416/97 R

* cited by examiner

*Primary Examiner* — Anh Mai

(57) ABSTRACT

A turbine blade having an internal cooling system with incremental serpentine cooling channels in near walls forming an outer surface of the turbine blade is disclosed. The turbine blade may be formed from an internal structural spar that is covered with a thermal skin. The incremental serpentine cooling channels may be cut into the outer surface of the spar to which the thermal skin may be attached. The incremental serpentine cooling channels may be formed from two or more serpentine cooling channels aligned along an axis that extends generally spanwise throughout the turbine blade. A row of incremental serpentine cooling channels may extend from a root to a tip of the blade, but a single incremental cooling channel does not.

12 Claims, 3 Drawing Sheets

TURBINE BLADE WITH INCREMENTAL SERPENTINE COOLING CHANNELS BENEATH A THERMAL SKIN

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Thus, a need exists for removing excessive heat in the tip section of turbine blades.

SUMMARY OF THE INVENTION

This invention relates to a turbine blade cooling system for turbine blades used in turbine engines. In particular, the turbine blade cooling system includes a cavity positioned between two or more walls forming a housing of the turbine blade. The cooling system may be formed from two or more incremental serpentine cooling channels forming at least one row of cooling channels generally aligned along an axis extending generally spanwise. The incremental serpentine cooling channels may number two, three, four or more cooling channels within a single row. The configuration of the cooling channels may be dictated by the configuration of the turbine blade and may be customized to the heat load of the airfoil. The cooling system provides fresh cooling fluids to the root first, and the cooling fluids are passed through a plurality of serpentine cooling channels such that cooling fluids increase in temperature moving radially outward. The incremental serpentine cooling channels may be formed from any appropriate number of passes and in at least one embodiment, may be formed from a plurality of triple pass serpentine cooling channels. The near wall incremental serpentine cooling channel may be a forward or aft flowing serpentine cooling channel.

The turbine blade may be formed from a generally elongated blade having a leading edge, a trailing edge, a suction side, a pressure side generally opposite to the suction side, a tip wall at a first end, a root coupled to the blade at an end generally opposite the first end for supporting the blade and for coupling the blade to a disc, and at least one cavity forming a cooling system in the blade. The cooling system may include at least one midchord cooling channel and at least one near wall incremental serpentine cooling channel positioned immediately proximate to an outer surface of the generally elongated blade. The near wall incremental serpentine cooling channel may be formed from at least two serpentine cooling channels aligned along a spanwise extending axis such that a radially outer turn of a radially inward serpentine cooling channel is immediately proximate to and radially inward of a radially inner turn of a radially outward serpentine cooling channel. In at least one embodiment, the cooling system may include a plurality of rows of near wall incremental serpentine cooling channels. The near wall incremental serpentine cooling channels may be positioned in a wall forming the suction side, the pressure side, the leading edge or the trailing edge, or in any combination thereof.

The turbine blade may be formed form an internal structural spar covered by a thermal skin attached radially outward of the near wall incremental serpentine cooling channel forming at least a portion of the radially outward side of the near wall incremental serpentine cooling channel. The thermal skin may be formed from a material that is different from a material forming internal walls of the aspects of the cooling system. The thermal skin may have a thickness between about 0.010 inches and about 0.030 inches. The thermal skin may include a plurality of orifices for transpiration cooling. For instance, the leading edge may include a plurality of orifices for transpiration cooling.

The near wall incremental serpentine cooling channel may include at least one exhaust channel in communication with the at least one midchord cooling channel and at least one exhaust channel in communication with the tip. A plurality of trailing edge pressure side exhaust slots may extend through the pressure side at the trailing edge and in communication with the cooling system. An aft flowing serpentine cooling channel may be positioned at a suction side overhang at the trailing edge and may include a plurality of pedestals.

An advantage of this invention is that the individual rows of incremental serpentine cooling channels may be designed based upon local airfoil gas side pressure distribution in both chordwise and spanwise directions.

Another advantage of this invention is that the individual rows of incremental serpentine cooling channels may be designed based upon the local airfoil external heat load to achieve a desired local metal temperature.

Yet another advantage of this invention is that the incremental serpentine cooling channels yield a higher internal convection cooling effectiveness than the single pass radial flow cooling techniques used in near wall cooling designs.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
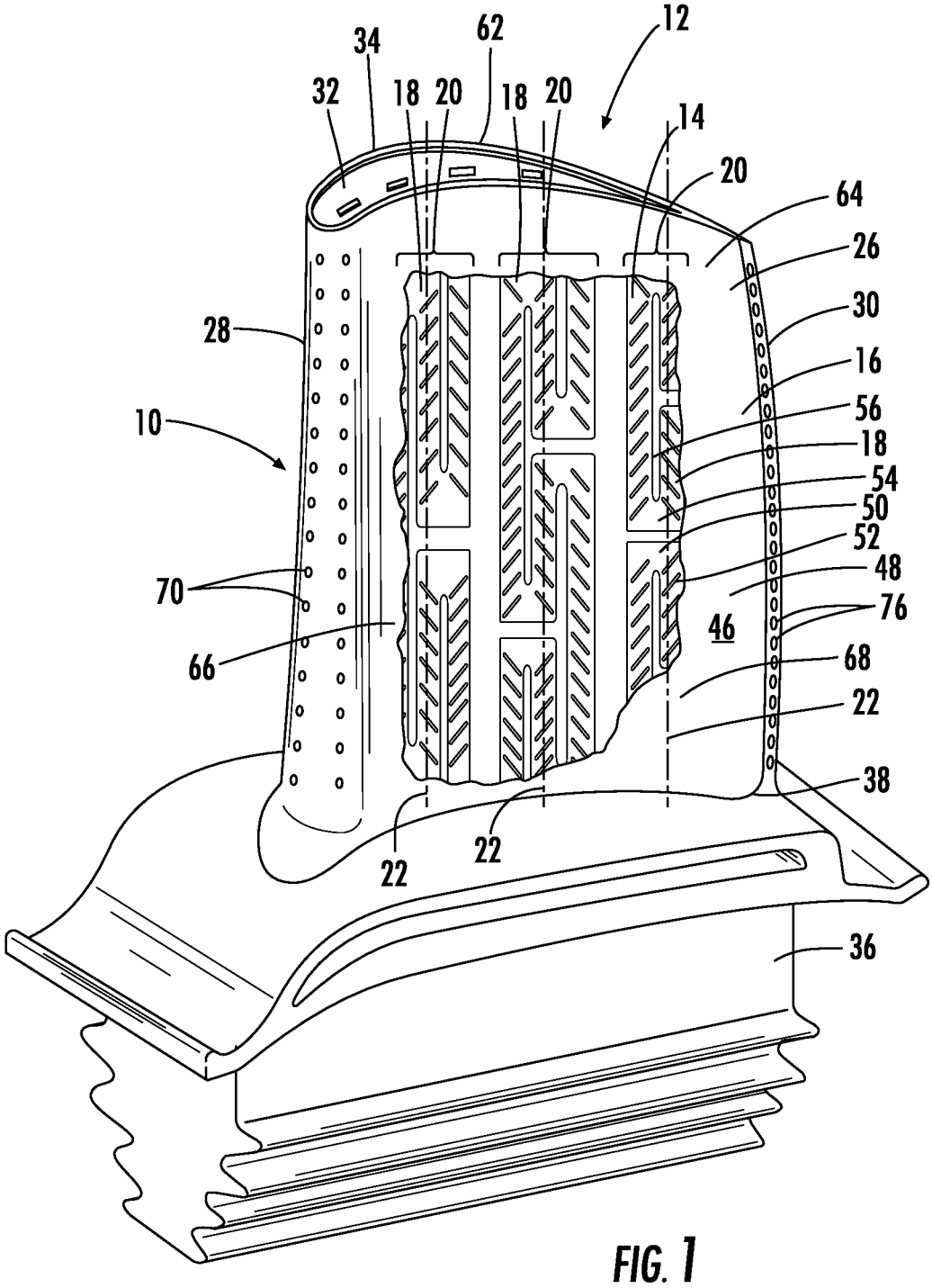
FIG. 1 is a perspective view with a partial detailed view of a turbine blade having features according to the instant invention.
Figure 2:
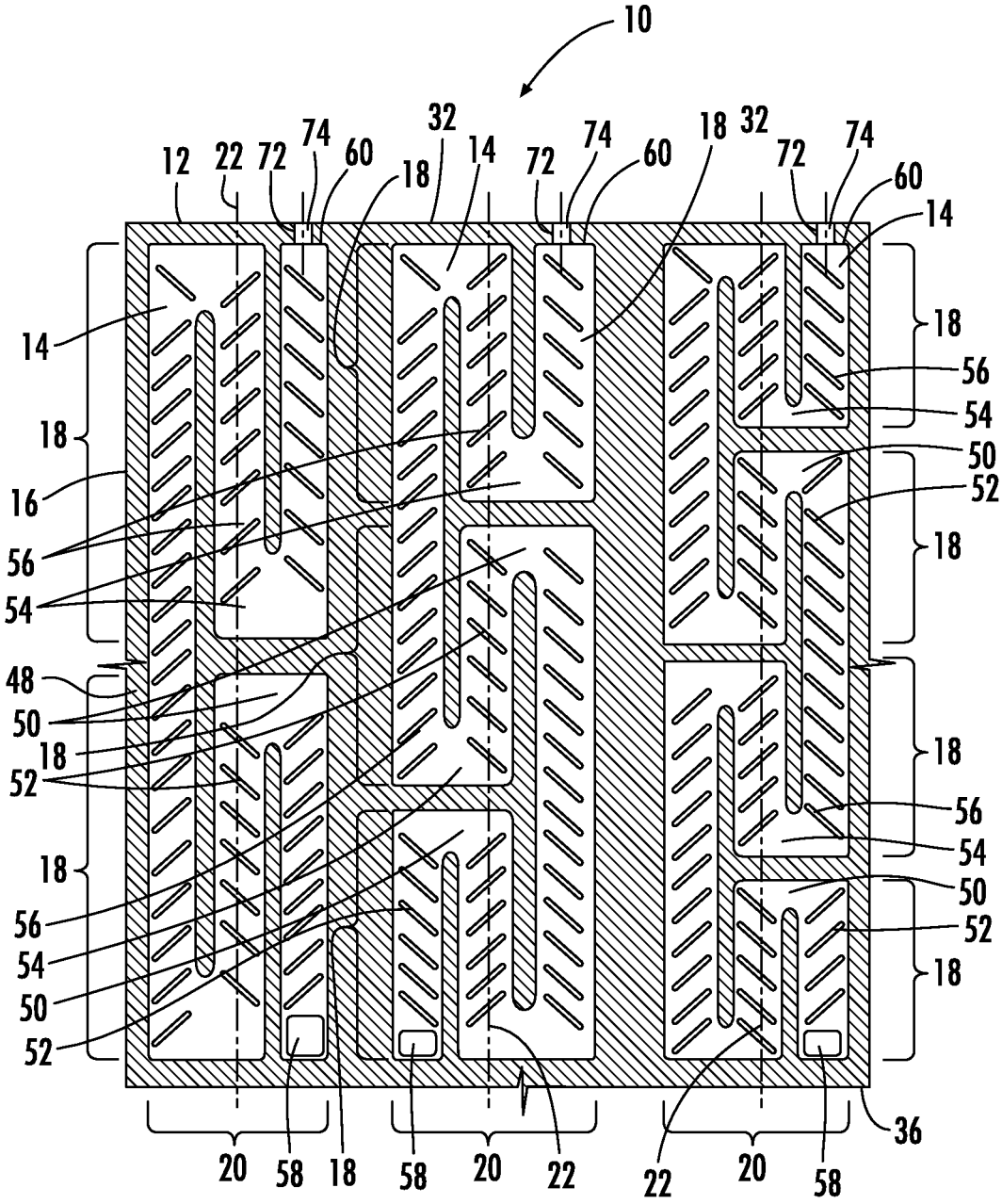
FIG. 2 is partial cross-sectional view of the turbine blade of FIG. 1 taken along section line 2-2.
Figure 3:
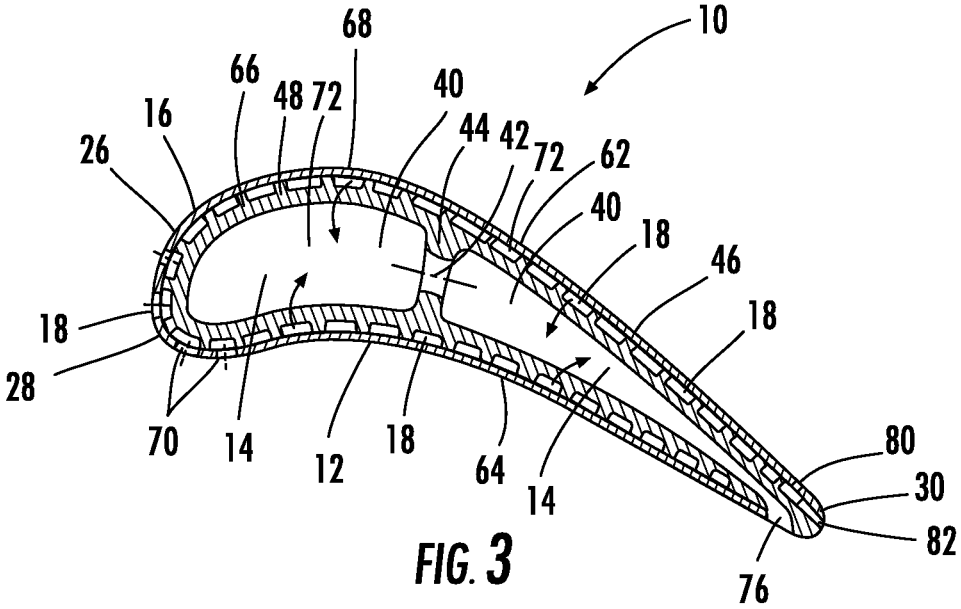
FIG. 3 is a cross-sectional view of the turbine blade taken along section line 3-3 in FIG. 1.
Figure 4:
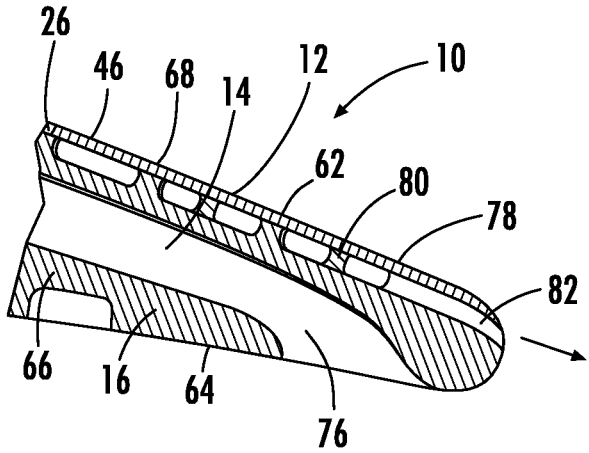
FIG. 4 is a detailed view of the trailing edge of the turbine blade.

As shown in FIGS. 1-4, this invention is directed to a turbine blade cooling system 10 for turbine blades 12 used in turbine engines. In particular, the turbine blade cooling system 10 includes a cavity 14, as shown in FIGS. 2 and 3, positioned between two or more walls forming a housing 16 of the turbine blade 12. The cooling system 10 may be formed from two or more incremental serpentine cooling channels 18 forming at least one row 20 of cooling channels 18 generally aligned along an axis 22 extending generally spanwise. The incremental serpentine cooling channels 18 may number two, three, four or more cooling channels 18 within a single row 20. The configuration of the cooling channels 18 may be dictated by the configuration of the turbine blade 12.

As shown in FIG. 1, the turbine blade 12 may be formed from a generally elongated blade 26 having a leading edge 28, a trailing edge 30, a tip 32 at a first end 34, a root 36 coupled to the blade 26 at an end 38 generally opposite the first end 34 for supporting the blade 26 and for coupling the blade 26 to a disc, and the at least one cavity 14 forming the cooling system 10 in the blade 26. The cooling system 10 may also include one or more midchord cooling channels 40. As shown in FIG. 3, the midchord cooling channels 40 may be formed from two or more channels connected with one or more midchord orifices 42 in a midchord rib 44. The midchord cooling channel 40 may have any appropriate configuration within internal aspects of the elongated blade 26.

The near wall incremental serpentine cooling channel 18 may be positioned immediately proximate to an outer surface 46 of the generally elongated blade 26 in a near wall 48 forming the housing 16 of the turbine blade 12. In at least one embodiment, the near wall incremental serpentine cooling channel 18 may be formed from two or more serpentine cooling channels 18 aligned along a spanwise extending axis 22 such that a radially outer turn 50 of a radially inward serpentine cooling channel 52 is immediately proximate to and radially inward of a radially inner turn 54 of a radially outward serpentine cooling channel 56. As such, the near wall incremental serpentine cooling channel 18 is generally formed from a plurality of serpentine cooling channels positioned end to end along an axis 22. An inlet 58 of the radially innermost incremental serpentine cooling channel 18 may be positioned proximate to or within the root 36, and an outlet 60 of the radially outermost incremental serpentine cooling channel 18 may be positioned proximate to or positioned at the tip 32 of the turbine blade 12. The near wall incremental serpentine cooling channel 18 may be formed from any appropriate configuration or number of passes and in at least one embodiment, may be formed from a plurality of triple pass serpentine cooling channels 18. The cooling system 10 may be formed from forward flowing or aft flowing near wall incremental serpentine cooling channels 18, or any combination thereof.

As shown in FIGS. 1-3, the cooling system 10 of the turbine blade 12 may include a plurality of rows 20 of near wall incremental serpentine cooling channels 18. The rows 20 of near wall incremental serpentine cooling channels 18 may be generally aligned with each other and with the leading and trailing edges 28, 30. In at least one embodiment, a row 20 of near wall incremental serpentine cooling channels 18 has a chordwise width of between about ⅙ and ½ of a chordwise distance between the leading and trailing edges 28, 30. The cooling system 10 may include a plurality of rows 20 of near wall incremental serpentine cooling channels 18 positioned in a near wall 48 forming the suction side 62, the pressure side 64, the leading edge 28 or the trailing edge 30, any combination thereof including all of these locations.

The turbine blade 12 may be formed by an internal structural spar 66 that is formed from a material having sufficient strength to provide the structural integrity to the turbine blade 12. The structural spar 66 may be covered with a thermal skin 68 attached radially outward of the near wall incremental serpentine cooling channel 18 forming at least a portion of the radially outward side of the near wall incremental serpentine cooling channel 18. The near wall incremental serpentine cooling channel 18 may be cut into the outer surface of the structural spar 66 using any appropriate method. The thermal skin 68 may be formed from a material, such as, but not limited to Alloy247, that is different from a material forming internal walls 66 of the aspects of the cooling system 10. The thermal skin may have a thickness between about 0.010 inches and about 0.030 inches. The internal structural spar 66 may be formed by casting with a built-in midchord cooling channel 40. The thermal skin 68 may be attached to the spar 66 through use of any appropriate method, such as, but not limited to, a transient liquid phase (TLP) bonding process. The thermal skin 68 can be formed from a single piece or from multiple pieces. The thermal skin 68 may be formed from materials capable of handling high temperatures in a thin sheet metal form. The thermal skin 68 may include a plurality of orifices 70 for transpiration cooling. The thermal skin 68 may include a plurality of orifices 70 at the leading edge 28 for transpiration cooling.

The cooling system 10 may exhaust cooling fluids from the turbine blade and may capture of those cooling fluids after passing through a row 20 of incremental serpentine cooling channels 18 and route those cooling fluids into the midchord cooling channel 40 through a midchord exhaust channel 72. The cooling system may also include tip exhaust channels 74 extending radially outward from the rows 20 of near wall incremental serpentine cooling channels 18. A portion of the cooling fluids from the near wall incremental serpentine cooling channels 18 flow through the tip exhaust channels 74 to cool the tip 32.

The cooling system 10 may also include a plurality of trailing edge pressure side exhaust slots 76 extending through the pressure side 64 at the trailing edge 30 and in communication with the cooling system 10. In one embodiment, the midchord cooling channels 40 may be in fluid communication with the plurality of trailing edge pressure side exhaust slots 76 to exhaust the mid-chord cooling fluids through the trailing edge 30. The cooling system 10 may also include an aft flowing serpentine cooling channel 78 at a suction side 62 overhang at the trailing edge 30 and may include a plurality of pedestals 80.

During operation, cooling fluids, which may be, but are not limited to, air, flow into the cooling system 10 from a cooling supply system upstream of the root 36 in the cooling system. The cooling fluids flow into the inlets 58 of the near wall incremental serpentine cooling channel 18 and into the near wall incremental serpentine cooling channel 18 themselves. The cooling fluids flow through the serpentine cooling channels 18 and increase in temperature due to collision with the walls forming the channels 18 and the trips strips within the channels 18. A portion of the fluids may then be exhausted through the tip exhaust channels 74 and a portion of the fluids may be passed through the midchord exhaust channels 72 into the midchord cooling channels 40. The cooling fluids sent to the midchord cooling channels 40 may be used for trailing edge cooling or main body film cooling applications. The portion of fluids passed to the trailing edge 30 are exhausted through the trailing edge pressure side exhaust slots 76.

Cooling fluids may also be passed into an aft flowing trailing edge serpentine cooling channel 78 at the suction side 62 of the trailing edge 30. The cooling fluids flow through the channel 78, pass pedestals 80 and are exhausted through a plurality of orifices 82 to in the suction side 62 for cooling the suction side corner at the intersection of the suction side 62 and the trailing edge 30.

Because the cooling fluids are passed through the near wall incremental serpentine cooling channels 18 from the root 36 to the tip 32, the cooling fluids provide fresh cooling fluids to the root 36 first, thereby enhancing the blade high cycle fatigue (HCF) capability. The temperature of the cooling fluids increases as the cooling fluids flow radially outwardly through the near wall incremental serpentine cooling channels 18, which reduces the cooling capacity of the cooling fluids and induces hotter near wall 48 temperatures in the upper blade span. Nonetheless, the pull stress at the turbine blade upper span is low, and the allowable turbine blade 12 metal temperature is high. The turbine blade cooling system 10 therefore achieves a balanced thermal design.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a suction side, a pressure side generally opposite to the suction side, a tip wall at a first end, a root coupled to the blade at an end generally opposite the first end for supporting the blade and for coupling the blade to a disc, and at least one cavity forming a cooling system in the blade;

wherein the cooling system comprises at least one midchord cooling channel and at least one near wall incremental serpentine cooling channel positioned immediately proximate to an outer surface of the generally elongated blade;

wherein the near wall incremental serpentine cooling channel is formed from at least two serpentine cooling channels aligned along a spanwise extending axis such that a radially outer turn of a radially inward serpentine cooling channel is immediately proximate to and radially inward of a radially inner turn of a radially outward serpentine cooling channel;

wherein the near wall incremental serpentine cooling channel comprises a plurality of rows of near wall incremental serpentine cooling channels, wherein the near wall incremental serpentine cooling channel comprises a plurality of rows of near wall incremental serpentine cooling channels positioned in a wall forming the suction side, wherein the plurality of rows of serpentine cooling channels in the wall forming the suction side includes a first serpentine cooling channel formed from two triple pass serpentine cooling channels aligned in series, a second serpentine cooling channel formed from three triple pass serpentine cooling channels aligned in series, and a third serpentine cooling channel formed from four triple pass serpentine cooling channels aligned in series, wherein the second serpentine cooling channel is positioned between the first and third serpentine cooling channels; and wherein the near wall incremental serpentine cooling channel comprises a plurality of rows of near wall incremental serpentine cooling channels positioned in a wall forming the pressure side, wherein the plurality of rows of serpentine cooling channels in the wall forming the pressure side includes a first serpentine cooling channel formed from two triple pass serpentine cooling channels aligned in series, a second serpentine cooling channel formed from three triple pass serpentine cooling channels aligned in series, and a third serpentine cooling channel formed from four triple pass serpentine cooling channels aligned in series, wherein the second serpentine cooling channel is positioned between the first and third serpentine cooling channels.

2. The turbine blade of claim 1, further comprising a thermal skin attached radially outward of the near wall incremental serpentine cooling channel forming at least a portion of the radially outward side of the near wall incremental serpentine cooling channel, wherein the thermal skin is formed from a material that is different from a material forming internal walls of the aspects of the cooling system.

3. The turbine blade of claim 2, wherein the thermal skin has a thickness between about 0.010 inches and about 0.030 inches.

4. The turbine blade of claim 1, wherein the near wall incremental serpentine cooling channel is formed from forward flowing serpentine cooling channels.

5. The turbine blade of claim 1, wherein the near wall incremental serpentine cooling channel is formed from aft flowing serpentine cooling channels.

6. The turbine blade of claim 1, wherein the leading edge further comprises a plurality of orifices for transpiration cooling.

7. The turbine blade of claim 1, wherein the near wall incremental serpentine cooling channel includes at least one exhaust channel in communication with the at least one midchord cooling channel and at least one exhaust channel in communication with the tip.

8. The turbine blade of claim 1, further comprising a plurality of trailing edge pressure side exhaust slots extending through the pressure side at the trailing edge and in communication with the cooling system.

9. The turbine blade of claim 1, further comprising an aft flowing serpentine cooling channel at a suction side overhang at the trailing edge and including a plurality of pedestals.

10. A turbine blade, comprising:

a generally elongated blade having a leading edge, a trailing edge, a suction side, a pressure side generally opposite to the suction side, a tip wall at a first end, a root coupled to the blade at an end generally opposite the first end for supporting the blade and for coupling the blade to a disc, and at least one cavity forming a cooling system in the blade;

wherein the cooling system comprises at least one midchord cooling channel and a plurality of rows of near wall incremental serpentine cooling channels positioned immediately proximate to an outer surface of the generally elongated blade on the pressure and suction sides;

wherein the near wall incremental serpentine cooling channel is formed from at least two serpentine cooling channels aligned along a spanwise extending axis such that a radially outer turn of a radially inward serpentine cooling channel is immediately proximate to and radially inward of a radially inner turn of a radially outward serpentine cooling channel;

wherein the near wall incremental serpentine cooling channel is formed from a plurality of triple pass serpentine cooling channels;

a thermal skin attached radially outward of the near wall incremental serpentine cooling channel forming at least a portion of the radially outward side of the near wall incremental serpentine cooling channel, wherein the thermal skin is formed from a material that is different from a material forming internal walls of the aspects of the cooling system;

wherein the near wall incremental serpentine cooling channel comprises a plurality of rows of near wall incremental serpentine cooling channels;

wherein the near wall incremental serpentine cooling channel comprises a plurality of rows of near wall incremental serpentine cooling channels positioned in a wall forming the suction side, wherein the plurality of rows of serpentine cooling channels in the wall forming the suction side includes a first serpentine cooling channel formed from two triple pass serpentine cooling channels aligned in series, a second serpentine cooling channel formed from three triple pass serpentine cooling channels aligned in series, and a third serpentine cooling channel formed from four triple pass serpentine cooling channels aligned in series, wherein the second serpentine cooling channel is positioned between the first and third serpentine cooling channels; and wherein the near wall incremental serpentine cooling channel comprises a plurality of rows of near wall incremental serpentine cooling channels positioned in a wall forming the pressure side, wherein the plurality of rows of serpentine cooling channels in the wall forming the pressure side includes a first serpentine cooling channel formed from two triple pass serpentine cooling channels aligned in series, a second serpentine cooling channel formed from three triple pass serpentine cooling channels aligned in series, and a third serpentine cooling channel formed from four triple pass serpentine cooling channels aligned in series, wherein the second serpentine cooling channel is positioned between the first and third serpentine cooling channels.

11. The turbine blade of claim 10, wherein the near wall incremental serpentine cooling channel includes at least one exhaust channel in communication with the at least one mid-chord cooling channel and at least one exhaust channel in communication with the tip.

12. The turbine blade of claim 10, further comprising a plurality of trailing edge pressure side exhaust slots extending through the pressure side at the trailing edge and in communication with the cooling system and further comprising an aft flowing serpentine cooling channel at a suction side overhang at the trailing edge and including a plurality of pedestals.

* * * * *